US008107831B2

(12) United States Patent
Hata

(10) Patent No.: US 8,107,831 B2
(45) Date of Patent: Jan. 31, 2012

(54) ELECTRONIC DEVICE AND IMAGE FORMING APPARATUS

(75) Inventor: Yousuke Hata, Matsudo (JP)

(73) Assignee: Canon Kabushiki Kaisha (JP)

( * ) Notice: Subject to any disclaimer, the term of this patent is extended or adjusted under 35 U.S.C. 154(b) by 444 days.

(21) Appl. No.: 12/481,724

(22) Filed: Jun. 10, 2009

(65) Prior Publication Data

US 2009/0304401 A1 Dec. 10, 2009

(30) Foreign Application Priority Data

Jun. 10, 2008 (JP) ..... 2008-151869

(51) Int. Cl.
*G03G 15/00* (2006.01)

(52) U.S. Cl. ..... 399/37; 399/88

(58) Field of Classification Search ..... 399/37, 399/88

See application file for complete search history.

(56) References Cited

U.S. PATENT DOCUMENTS 4,777,554 A * 10/1988 Gokita ..... 361/91.2
7,459,805 B2 * 12/2008 Kowari et al. ..... 307/130
7,609,988 B2 * 10/2009 Kishi et al. ..... 399/69

FOREIGN PATENT DOCUMENTS

JP 06-035562 A 2/1994
JP 2007-102008 A 4/2007

* cited by examiner

*Primary Examiner* — David Gray
*Assistant Examiner* — Rodney Bonnette
(74) *Attorney, Agent, or Firm* — Rossi, Kimms & McDowell LLP

(57) ABSTRACT

An electronic device and an image forming apparatus capable of notifying that a voltage drop will occur during operation of the device due to an abnormality of a power source facility before actual operations. A load is configured to operate on electric power supplied from a commercial power source. A detection unit is configured to detect a source voltage input from the commercial power source. A storage unit is configured to store an operation guarantee voltage value that is required for operation of said load. A control unit is configured to control electric power applied to said load. A notification unit configured to perform notification.

7 Claims, 7 Drawing Sheets

The power source environment to which the apparatus is connected is unstable.

- Source impedance is high.
- Please ask the facility administrator to check the power source facility.

The power source environment to which the apparatus is connected is unstable.

- Electric power shortage occurs.
- Check if any other device is connected to the same power source line.

ELECTRONIC DEVICE AND IMAGE FORMING APPARATUS

BACKGROUND OF THE INVENTION

1. Field of the Invention

The present invention relates to an electronic device such as an image forming apparatus that operates with a commercial power source to form images.

2. Description of the Related Art

In a conventional image forming apparatus using photosensitive member, an electrostatic latent image formed by laser irradiation on a photoconductor is developed with developer supplied from a developing unit to be made visible as a developer image, which is transferred onto recording paper and fixed in a fixing unit.

Such a fixing unit is heated to a high temperature in order to dissolve developer on recording paper and fix it on the recording paper. An induction coil, a halogen heater or the like is used as a heat source for such heating, and the fixing unit is typically adjusted to a temperature close to 200° C. depending on the type of the image forming apparatus. When recording paper passes through the fixing unit, the recording paper is deprived of heat due to dissolution of developer or the like. Since a quantity of heat that transfers from the fixing unit to recording paper increases especially at the time of continuous printing, the temperature of the fixing unit may decrease to cause an image defect, such as poor fixation, unless a large quantity of heat is supplied to the fixing unit.

Therefore, to compensate for such decrease in temperature of the fixing unit, a large amount of electric power needs to be supplied to the fixing unit. For example, an image forming apparatus including a fixing unit that uses an induction coil as a heat source applies a large amount of electric power exceeding 1000 W to the induction coil. As a result, a large amount of electric current exceeding 10 amperes would flow in an environment with a rated voltage of 100 V, for example.

As a fixing unit consumes a large amount of electric power as mentioned above, power consumption during operation of an image forming apparatus including loads other than the fixing unit is very large. Accordingly, an operational problem or the like can occur in an unstable power source environment in which the voltage of a commercial power source to which an apparatus is connected is low and/or the capacity of a power source is insufficient.

Thus, techniques for enabling operation without causing a malfunction even in an environment with unstable source voltage have been disclosed. For instance, a technique has been disclosed that detects an input voltage drop of the commercial power source during operation of an apparatus and upon detecting reduction of the source voltage below a certain reference value, suspends operation, and returns the apparatus to its initial operation (see Japanese Laid-Open Patent Publication (Kokai) No. 06-35562).

However, when this technique is applied to an image forming apparatus, the apparatus suspends its operation upon the input voltage drop of the commercial power source during printing because the apparatus is once initialized when the input voltage drop of the commercial power source has been detected.

Thus, a technique has been disclosed that reduces power consumption of an image forming apparatus when source voltage has dropped during operation of the apparatus without suspending or initializing the operation thereof (see Japanese Laid-Open Patent Publication (Kokai) No. 2007-102008). This technique enables a printing or warming up operation to be continued while reducing power consumption by reducing fixation input power and also decreasing printing speed (or sheet delivery speed) or extending the paper supply interval.

However, the techniques of Japanese Laid-Open Patent Publication (Kokai) Nos. 06-35562 and 2007-102008 relate to methods for addressing the input voltage drop of the power source that occurs during operation of an apparatus and require actual operation of the apparatus. Moreover, the techniques do not identify the cause of the input voltage drop of the power source. In particular, the technique of Japanese Laid-Open Patent Publication (Kokai) No. 06-35562 does not make a distinction about the cause of the input voltage drop of the power source whether it is caused by high source impedance or an external factor such as sharing of a power source.

For example, when source voltage is low due to an abnormality of a power source facility, an apparatus can be operated with the above-described handling method, but the performance that the apparatus is supposed to provide cannot be derived because of initialization of the apparatus and/or reduction of printing speed unless the cause of the problem is addressed. In addition, if the cause of a problem is left unidentified, such handling as described above has to be repeated every time the apparatus operates.

Therefore, if an abnormality or the like of a power source facility could be detected before an apparatus is actually operated and a voltage drop occurs, it would be desirable to inform a user of the cause of the trouble and prompt the user to address it.

This also applies to other electronic devices that bear loads.

SUMMARY OF THE INVENTION

The present invention provides an electronic device and an image forming apparatus capable of notifying that a voltage drop will occur during operation due to an abnormality of a power source facility before actual operations.

Accordingly, in a first aspect of the present invention, there is provided an electronic device, comprising a load configured to operate on electric power supplied from a commercial power source, a detection unit configured to detect a source voltage input from the commercial power source, a storage unit configured to store an operation guarantee voltage value that is required for operation of the load, a control unit configured to control electric power applied to the load, and, a notification unit configured to perform notification, wherein the control unit computes a source voltage at the time of operation of the load as a predicted voltage value based on a first voltage value detected by the detection unit while electric power of a first value is applied to the load and a second voltage value detected by the detection unit while electric power of a second value which is greater than the first value is applied to the load, and if the predicted voltage value computed is smaller than the operation guarantee voltage value stored in the storage unit, performs predetermined notification via the notification unit.

Accordingly, in a second aspect of the present invention, there is provided an image forming apparatus that operates on electric power supplied from a commercial power source, the image forming apparatus comprising an image forming section configured to form a toner image on a sheet, a fixing unit configured to heat and fix the toner image formed on the sheet, a fixing unit control section configured to control electric power supplied to the fixing unit, a voltage detecting section configured to detect a voltage input from the commercial power source to the image forming apparatus, a storage section configured to store an operation guarantee voltage value required for an image forming operation, and a control section configured to control the fixing unit control section so that electric power supplied to the fixing unit is adjusted, wherein based on a first voltage value detected by the voltage detecting section while electric power of a first value is supplied to the fixing unit and a second voltage value detected by the voltage detecting section while electric power of a second value which is greater than the electric power of the first value is supplied to the fixing unit, the control section computes a voltage that is applied from the commercial power source to the image forming apparatus when the fixing unit is operated with electric power of a third value at the time of an image forming operation which is greater than the second value, and if the computed voltage is smaller than the operation guarantee voltage value, issues a warning.

According to the present invention, it is possible to provide a notification that a voltage drop will occur during operation due to an abnormality of a power source facility before actual operation.

The above and other objects, features and advantages of the invention will become more apparent from the following detailed description taken in conjunction with the accompanying drawings.

DETAILED DESCRIPTION OF PREFERRED EMBODIMENTS

Hereinafter, embodiments of the present invention will be described with reference to drawings.

Figure 1:
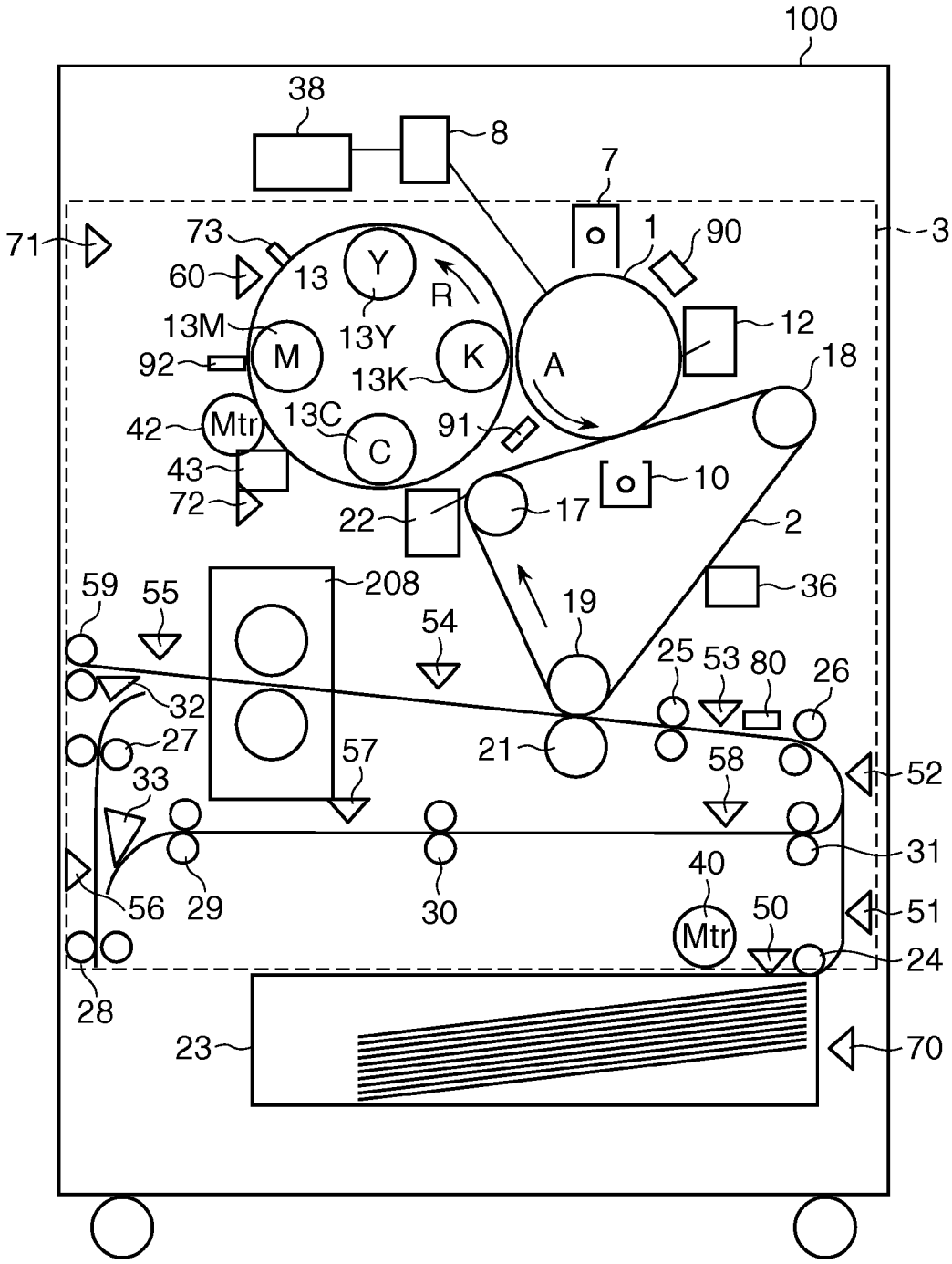
FIG. 1 is a schematic cross-sectional view showing an internal configuration of an image forming apparatus as an electronic device according to a first embodiment of the present invention.

FIG. 1 is a schematic cross-sectional view showing an internal configuration of an image forming apparatus as an electronic device according to a first embodiment of the present invention.

An image forming apparatus 100 as an electronic device is configured as a color printer which operates on electric power supplied from a commercial power source and has an image forming section 3 for forming an image on recording paper. The image forming section 3 includes various types of loads.

In the image forming section 3, a photoconductive drum (hereinafter abbreviated as a "photoconductor") 1 as an image carrier is provided that is designed to rotate in the direction shown by arrow A with a motor not shown. Around the photoconductor 1, a pre-exposure lamp 90, a primary charger 7, an exposure unit 8, a rotational developing unit 13, a density sensor 91, a transfer unit 10, and a cleaner unit 12 are arranged.

The rotational developing unit 13 internally contains developing units 13Y, 13M, 13C, and 13K, which correspond to four colors for full-color development. In the vicinity of the rotational developing unit 13, a driving motor 42, a solenoid 43, and a lock detection sensor 72 are provided. The driving motor 42 is a stepping motor for rotating the rotational developing unit 13. The solenoid 43 operates a locking mechanism for fixing the position of the rotational developing unit 13. The lock detection sensor 72 is a photo-interrupter for detecting the operation of the locking mechanism as described above.

On the rotational developing unit 13, a position detection flag 73 is attached. Moreover, a rotational developing unit home position sensor 60 for detecting the position of the rotational developing unit 13 is provided. The rotational developing unit home position sensor 60 detects the position of the rotational developing unit 13 by detecting the position detection flag 73. Moreover, a toner density detection sensor 92 optically detects the toner density of developer carried on a developing sleeve of the rotational developing unit 13.

The developing units 13Y, 13M, 13C, and 13K develop a latent image formed on the photoconductor 1 with toners of Y (yellow), M (magenta), C (cyan), and K (black), respectively. When the toner of each color is developed, the rotational developing unit 13 is rotated in the direction of arrow R with the driving force of the driving motor 42. Then, by detecting the position detection flag 73 attached on the rotational developing unit 13 with the rotational developing unit home position sensor 60, a reference position of the rotational developing unit 13 is detected and the rotational developing unit 13 is rotated to a predetermined rotation position. This positions a developing unit of the target color in contact with the photoconductor 1.

Toner images of the individual colors developed on the photoconductor 1 are sequentially transferred onto a belt 2, which serves as an intermediate transfer body, by the transfer unit 10 so that toner images of four colors are overlaid on top of each other. The belt 2 is stretched on rollers 17, 18, and 19. The roller 17 is coupled to a driving source, not shown, and functions as a driving roller for driving the belt 2, and the roller 18 functions as a tension roller for adjusting the tension of the belt 2. The roller 19 functions as a backup roller for a secondary transfer unit 21. Between the roller 18 and the roller 19, a reflective position sensor 36 for detecting the reference position is provided.

On a position opposite to the roller 17 across the belt 2, a belt cleaner 22 is provided such that it can be brought into contact with or separated from the belt 2, and remaining toner on the belt 2 after secondary transfer is scraped off by a cleaner blade of the belt cleaner 22. Recording paper placed in a recording paper cassette 23 is lifted to a position that is in contact with a pickup roller 24 with operation of a lift motor 40. Recording paper drawn onto a paper path by the pickup roller 24 from the recording paper cassette 23 is delivered to a nip portion, i.e., a point where the secondary transfer unit 21 and the belt 2 are in contact with each other, by a pair of rollers 25 and 26. A toner image formed on the belt 2 is transferred onto the recording paper at the nip portion, subjected to heat to be fixed in a fixing unit 208, and passes through an external discharge roller 59 to be ejected from the apparatus.

In a double-sided image forming operation, a flapper 32 is operated to carry recording paper in the direction of a carrier roller 27. After carrying the recording paper to a point past the flapper 33 by a carrier roller 28, the carrier roller 28 is rotated in the reverse direction and the flapper 33 is operated so as to carry the recording paper in the direction of a carrier roller 29 and carry the paper on carrier rollers 30 and 31. The recording paper thereby merges with the paper path from the recording paper cassette 23, enabling formation of an image on the reverse side of the first image.

With such a configuration, an image is formed in the following manner. First, a voltage is applied to the primary charger 7 to negatively charge the surface of the photoconductor 1 uniformly at a predetermined potential. Then, exposure is performed by the exposure unit 8, which is composed of a laser scanner, such that an image portion on the charged photoconductor 1 is at an intended exposed-portion potential to form a latent image thereon. The exposure unit 8 turns on and off exposure based on image signals generated in an image control section 38 to form a latent image corresponding to an image.

Timing of image formation is controlled based on an ITOP ("image top") signal, which indicates that a predetermined position on the belt 2 has been detected by a sensor not shown. A developing bias voltage that is preset for each color is applied to the developing unit 13Y and so on, and the latent image is developed with toner when it passes the position of each developing unit to become visible as a toner image. The toner image is transferred onto the belt 2 by the transfer unit 10 and further transferred onto recording paper by the secondary transfer unit 21, and then supplied to the fixing unit 208. In full-color printing, toners of four colors are overlaid on the belt and transferred onto recording paper. Any toner remaining on the photoconductor 1 is removed and collected by the cleaner unit 12, and finally the photoconductor 1 is uniformly discharged to about 0 volts by the pre-exposure lamp 90 in preparation for the next image formation cycle.

In addition, a paper height sensor 50 for detecting the height of paper in the recording paper cassette 23 is provided. Moreover, carriage sensors 51 to 58 are provided that detect the presence or absence of recording paper at individual points defined on paper paths or the timing of carrying recording paper. The moisture content of paper carried on a paper path is measured by a sensor 80. A cassette insertion/removal sensor 70 detects insertion or removal of the recording paper cassette 23. A door opening/closing switch 71 operates in accordance with opening and closing of a door that permits access to the inside of the main body. By interrupting or connecting the power supply to the driving load with the door opening/closing switch 71, an inadvertent malfunction that can occur when an operator touches the inside of the apparatus is avoided and the operator's safety is ensured.

Figure 2:
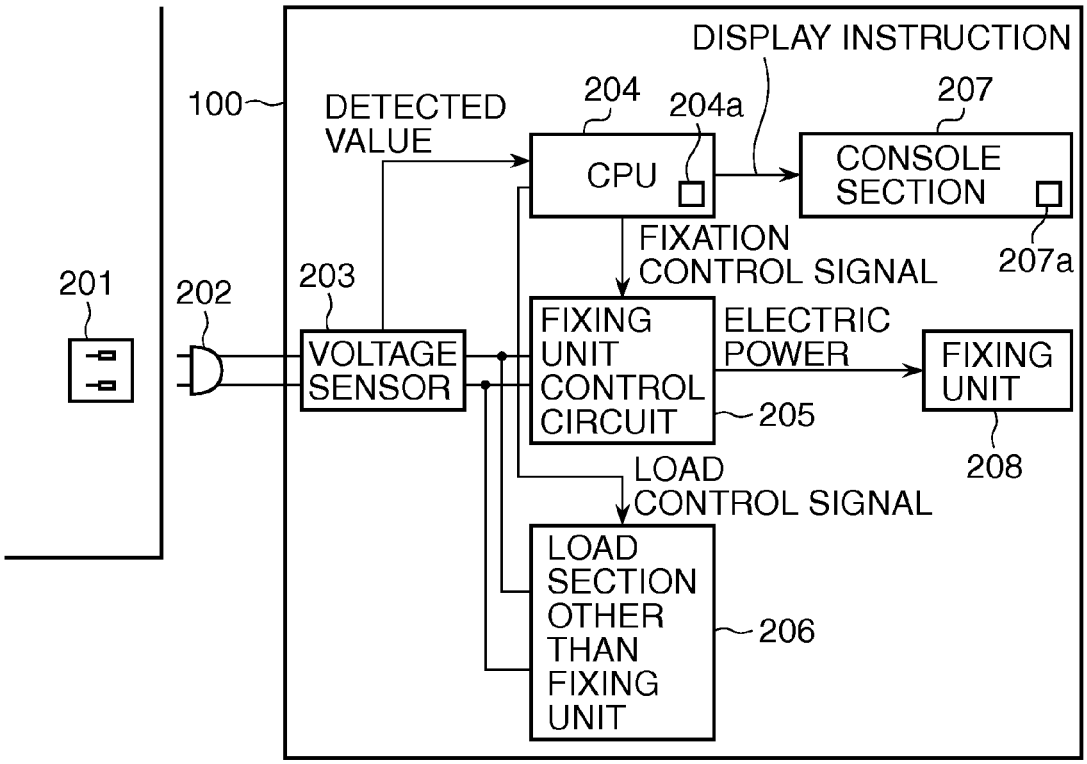
FIG. 2 is a block diagram showing a functional configuration of the image forming apparatus of FIG. 1.

FIG. 2 is a block diagram showing a functional configuration of the image forming apparatus 100 of FIG. 1. In addition to the fixing unit 208, the image forming apparatus 100 includes a voltage sensor 203, a CPU 204, a fixing unit control circuit 205, a load section other than the fixing unit 206 and a console section 207. To the image forming apparatus 100, electric power is supplied from an outlet of a commercial power source 201 provided on a wall in a room or the like via a power source cable 202. Electric power supplied from the commercial power source 201 is supplied to the fixing unit 208 as load via the fixing unit control circuit 205, and to the load section 206 other than the fixing unit, such as a motor for driving the image forming apparatus 100.

The voltage sensor 203 detects a source voltage input from the commercial power source 201. The CPU 204 is responsible for control of operation of the entire image forming apparatus 100. The fixing unit control circuit 205 is responsible for controlling the fixing unit 208 in accordance with control by the CPU 204. Power for supply is also controlled by the CPU 204 via the fixing unit control circuit 205. The CPU 204 outputs a fixation control signal to the fixing unit control circuit 205 and outputs a load control signal to the load section 206 other than the fixing unit. Inside the CPU 204, a storage section 204*a* composed of ROM, RAM, or the like is provided. The CPU 204 performs operation on data stored in the storage section 204*a* and/or determination based on a result of operation. The console section 207 is used by the user to make settings for printing or the like. The console section 207 has a display section 207*a* and indicates a problem, such as an error or jam, and/or various types of information to a user or a maintenance person through display of information on the display section 207*a*.

Next, an input voltage drop of the power source during operation of the image forming apparatus 100 is described. First, the input voltage drop of the power source resulting from high impedance of a commercial power source is described using FIG. 3.

As mentioned above, since the image forming apparatus 100 has the fixing unit 208 that requires a large amount of electric power, a large quantity of electric current flows at the time of an image forming operation. In particular, the value of an inrush current at the moment when the image forming apparatus 100 starts operation is large because electric current flows to all load sections in the apparatus at once. For example, with a power source facility of 100V/15A, an inrush current close to 15 amperes may flow.

Moreover, when source impedance is high because, e.g., the power source cable 202 of the commercial power source 201 is thin, a voltage drop on the power source cable 202 becomes large. Therefore, when source impedance is higher than usual, source voltage significantly drops along with operation of the apparatus itself.

Figure 3:
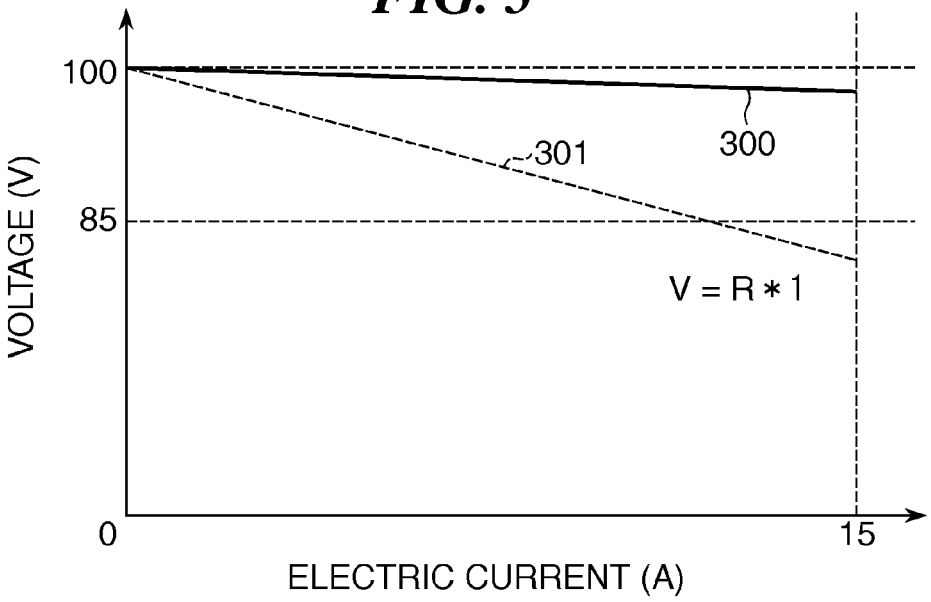
FIG. 3 is a graph showing the relation between an electric current that flows in the image forming apparatus of FIG. 1 and a source voltage in a 100V/15 A environment.

FIG. 3 illustrates the relation between an electric current that flows in the image forming apparatus 100 of FIG. 1 and a source voltage in a 100V/15 A environment. Under an ideal condition with infinitely small source impedance, little drop of source voltage occurs even if power consumption increases (straight line 300). However, when source impedance is high, a voltage drop associated with increase in electric current is large (straight line 301) Because source impedance is constant, the relation between increase in electric current and voltage drop is a proportional relationship.

Figure 4:
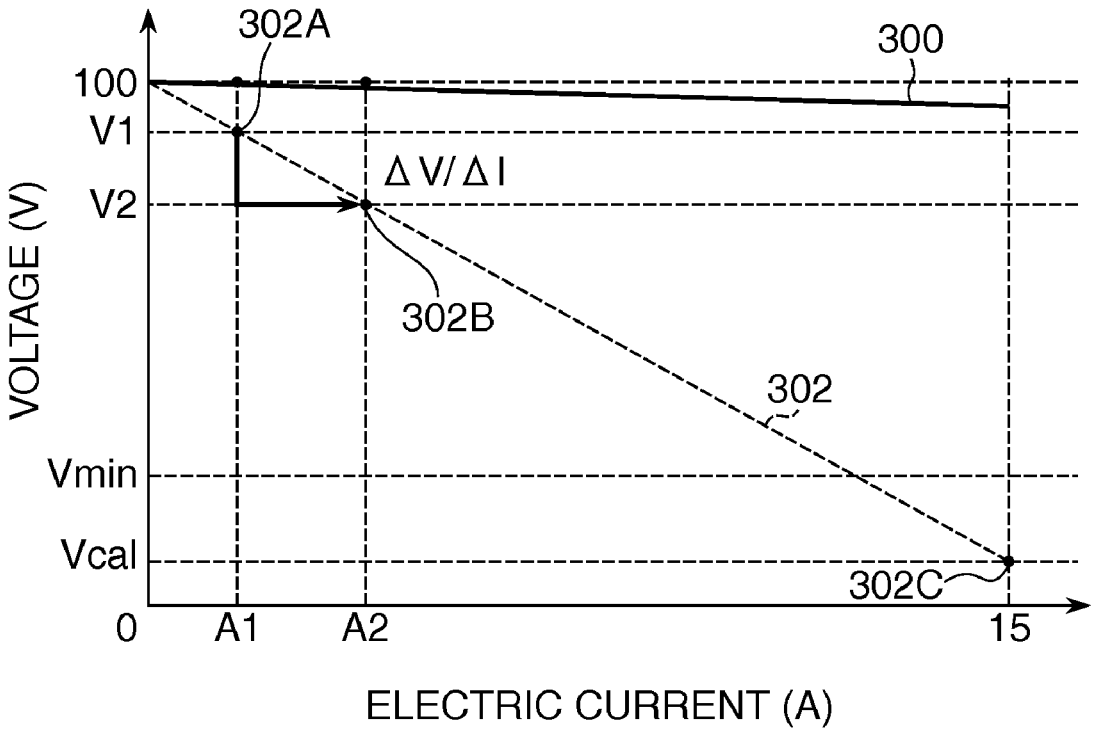
FIG. 4 is a graph showing the relation between the electric current in the image forming apparatus of FIG. 1 and the source voltage used in a 100V/15 A environment.

Next, a method of detecting a source impedance abnormality is described. FIG. 4 illustrates the relation between the electric current in the image forming apparatus 100 of FIG. 1 and the source voltage used in a 100V/15 A environment. Here, "15 A" is the maximum current value that flows at the time of an image forming operation and is maintained in the storage section 204*a*.

When a printing operation is not performed, such as during standby, little electric current flows. For example, electric current of electric current value A1 is passed so that electric power P1 of a constant first value is applied to the fixing unit 208, and source voltage at the time is detected by the voltage sensor 203. The detected source voltage is stored in the storage section 204*a* (see FIG. 2) as a first voltage value V1 in association with current value A1.

Then, electric power P2 of a second value which is greater than electric power P1 of the first value and is smaller than that of usual image forming operations is applied to the fixing unit 208. By way of example, if an electric current of 15 A flows during a usual printing operation, electric current of electric current value A2 (about 5A) that is smaller than 15 A and greater than current value A1 is passed, and source voltage at the time is detected by the voltage sensor 203. The detected source voltage is stored in the storage section 204*a* as a second voltage value V2 (302B) in association with electric current value A2.

Accordingly, from two points, plot point 302A representing the time of application of electric power P1 and plot point 302B representing the time of application of electric power P2, which were described above, the degree of voltage change ($\Delta V/\Delta I$) in the power source facility can be computed. Here, $\Delta V$ represents the degree of a voltage drop, where $\Delta V=V2-V1$ and $\Delta I=A2-A1$. An operation of calculating the degree of voltage change ($\Delta V/\Delta I$) can be performed utilizing a time when electric power is being applied to the fixing unit 208 during an apparatus warm-up or when the temperature of the fixing unit 208 is adjusted during standby.

Since the amount of a voltage drop associated with source impedance is proportional to the magnitude of electric current as mentioned above, it is possible to determine the straight line 302 from the computed degree of voltage change ($\Delta V/\Delta I$) (see FIG. 4). Therefore, plot point 302C representing the time of an image forming operation in which an electric current of 15 A flows can be predicted from the straight line 302. Then, from plot point 302C, source voltage during an image forming operation can be computed as predicted voltage value Vcal (see FIG. 4).

Figures 5, 6:
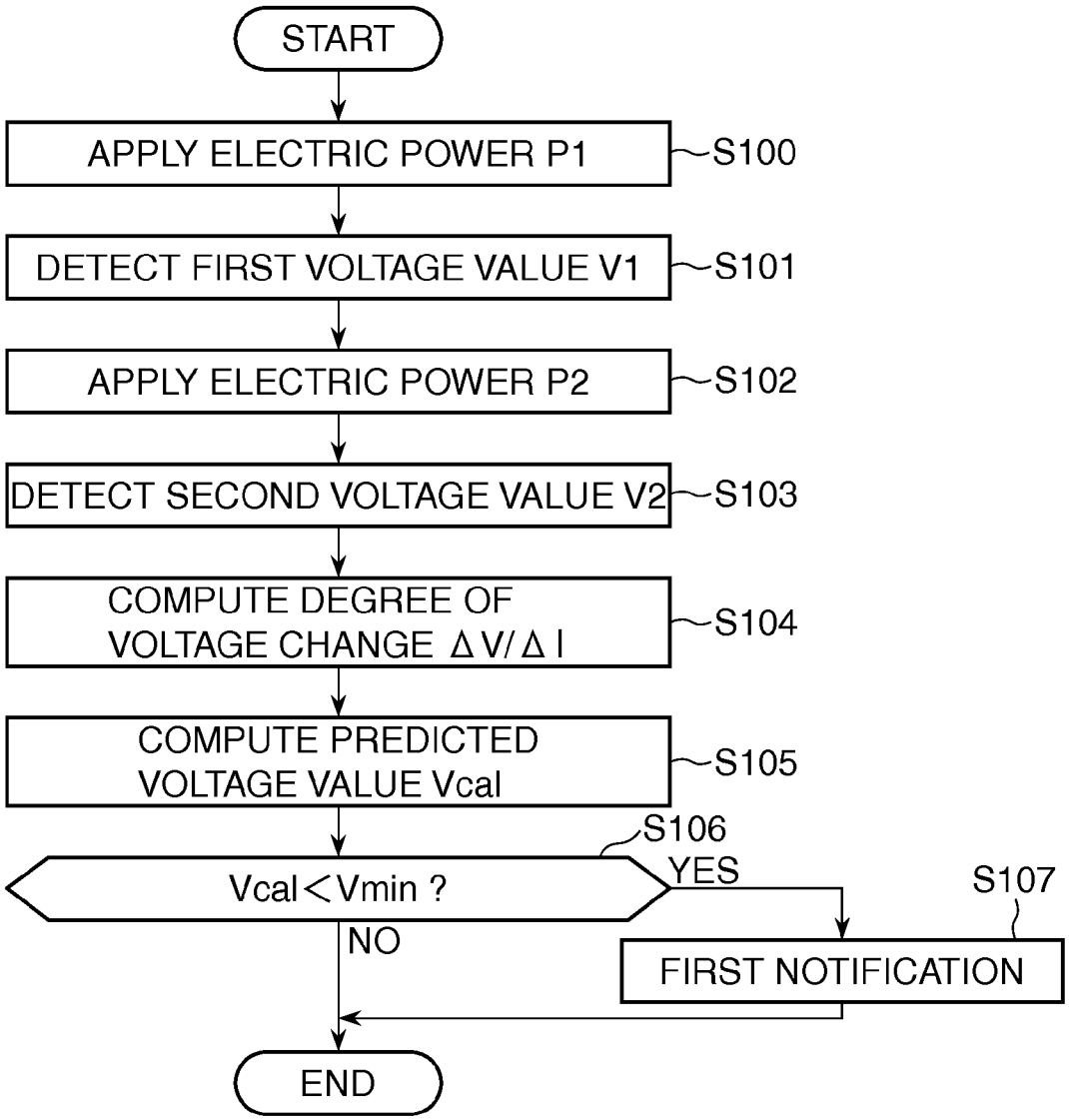
FIG. 5 is a flowchart of predicting and providing a notification about an abnormality of the power source voltage.
FIG. 6 is a view showing an example of displayed contents as a first notification.

Meanwhile, a lower limit value on minimum source voltage that is required for image formation performed by the image forming section 3 is prestored in the storage section 204*a* as operation guarantee voltage value Vmin (see FIG. 4). When the computed predicted voltage value Vcal is greater than the operation guarantee voltage value Vmin, an image formation operation can be carried out without a problem. However, when the predicted voltage value Vcal is below the operation guarantee voltage value Vmin, a malfunction of the apparatus is expected to occur due to the input voltage drop of the power source that is caused when the image forming section 3 is operated. It is therefore desirable to prompt the user or a maintenance person to take measures in advance. With reference to FIG. 5, a process up to calculation of predicted voltage value Vcal and notification for prompting improvement as required will be described in greater detail.

FIG. 5 is a flowchart of prediction and notification of an abnormality of the power source voltage. This process is executed by the CPU 204. It is assumed that the process is started when a predetermined mode is set with the image forming apparatus 100 powered up. The predetermined mode can be arbitrarily set by the user from the console section 207, for example.

First, the CPU 204 gives to the fixing unit control circuit 205 a control signal for passing an electric current of electric current value A1 so that electric power P1 of the first value is applied to the fixing unit 208 (step S100). Specifically, the CPU 204 determines electric current value A1 required for obtaining electric power P and outputs a PWM signal of a duty ratio corresponding to the current value A1 to the fixing unit control circuit 205. A lookup table showing the relation between electric current values and duty ratios is stored in the storage section 204a. The fixing unit control circuit 205 drives the fixing unit 208 in response to the PWM signal. As a result, an electric current of electric current value A1 flows to the fixing unit 208 (see FIG. 4). Then, the CPU 204 stores a source voltage at the time detected by the voltage sensor 203 in the storage section 204*a* (see FIG. 2) as the first voltage value V1 in association with electric current value A1 (step S101.

Next, the CPU 204 gives to the fixing unit control circuit 205 a control signal for passing an electric current of electric current value A2 so that electric power P2 of the second value which is greater than electric power P1 of the first value and smaller than that of a usual image forming operation is applied to the fixing unit 208 (step S102). As a result, an electric current of electric current value A2 flows to the fixing unit 208. Then, the CPU 204 stores a source voltage at the time detected by the voltage sensor 203 in the storage section 204*a* as the second voltage value V2 in association with electric current value A2 (step S103).

Next, the CPU 204 computes the degree of voltage change ($\Delta V/\Delta I$) from the electric current value A1 and first voltage value V1 (plot point 302A) and from the electric current value A2 and second voltage value V2 (plot point 302B) (step S104, see FIG. 4).

The CPU 204 then computes the predicted voltage value Vcal, which is the source voltage when the maximum electric current value of 15 A flows, from the degree of voltage change ($\Delta V/\Delta I$) (step S105). The CPU 204 then determines whether or not the predicted voltage value Vcal is smaller than the operation guarantee voltage value Vmin (see FIG. 4) (i.e., $Vcal<Vmin$) (step S106). If $Vcal \geqq Vmin$ as a result of the determination, the CPU 204 determines that there will be no problem in image forming operations and terminates this process without performing first notification (or predetermined notification). On the other hand, if $Vcal<Vmin$, it is expected that an operational problem will occur during image forming operations, thus the CPU 204 uses the console section 207 to perform first notification for indicating a source impedance abnormality (step S107) and then terminates this process.

FIG. 6 is an example of displayed contents as a first notification. As an example of the first notification, a message such as that shown in FIG. 6 is shown on the display section 207*a* of the console section 207. This message has contents indicating that there is a problem in the commercial power source facility environment and advising the user to request the facility administrator to check the power source facility. As a source impedance abnormality is not easy for the user to improve, the message should recommend that the user ask an administrator of the power source facility or the like to check the facility, as illustrated in FIG. 6.

According to the present embodiment, since the first notification is performed when $Vcal<Vmin$, it is possible to provide a notification that a voltage drop will occur during a printing operation due to an abnormality of the power source facility before an actual printing operation. Thereby, a power source facility administrator or a maintenance person can be notified of the cause of the problem and prompted to improve it so that the input voltage drop of the power source can be prevented. In addition, it eliminates the necessity to repeat such handling as initialization of the apparatus or reducing of printing speed every time the apparatus operates without the user knowing the cause of the problem.

While the first embodiment was described focusing on the input voltage drop of the power source caused by a source impedance abnormality, a second embodiment of the present invention further focuses on the input voltage drop of the power source that results from a shortage of electric power, such as when a power source is shared with other devices, and is described using FIGS. 7 to 11. The configuration of the image forming apparatus 100 according to the present embodiment is the same as the first embodiment, but the present embodiment assumes a case where the commercial power source 201 supplies electric power to a number of devices. Therefore, FIG. 7 will be used instead of FIG. 2. Moreover, since the process of predicting and providing notification about the abnormality of the power source voltage is different from that of the first embodiment, FIG. 10 will be used in place of FIG. 5.

Figure 7:
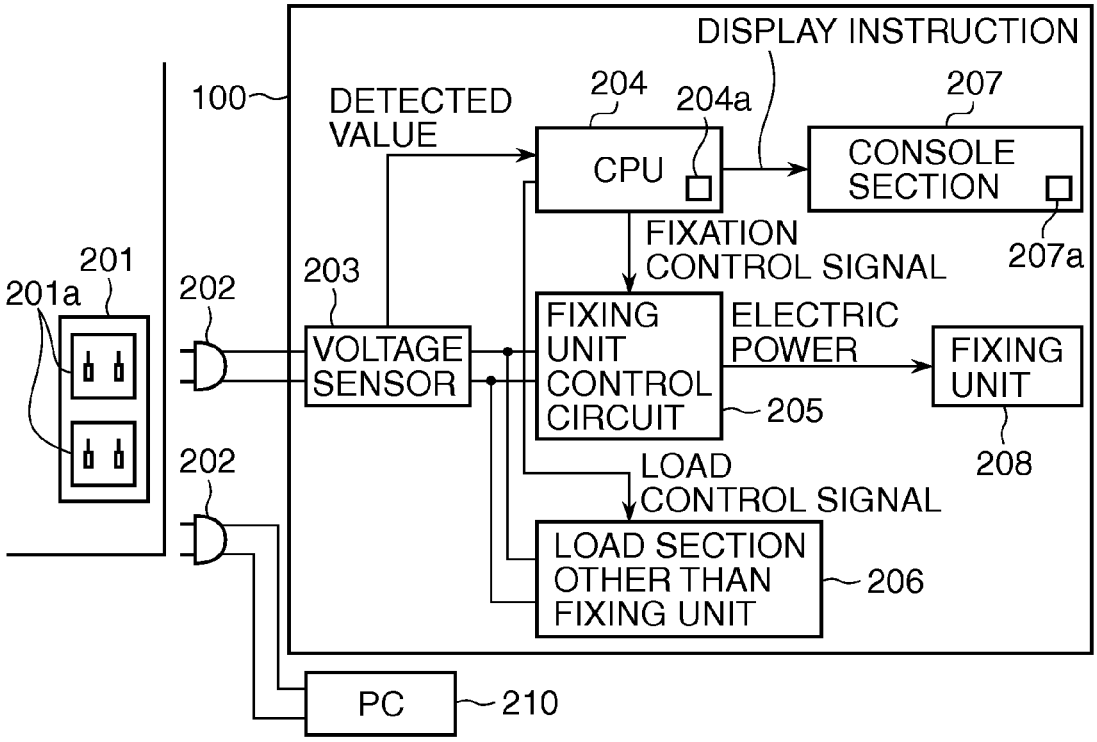
FIG. 7 is a schematic cross-sectional view showing an internal configuration of an image forming apparatus as an electronic device according to a second embodiment of the present invention.

FIG. 7 is a schematic cross-sectional view showing an internal configuration of an image forming apparatus as an electronic device according to the second embodiment of the invention.

Since the image forming apparatus 100 consumes a large amount of electric power as mentioned above, sharing of a power source with other devices is generally not intended in many cases. Therefore, when the image forming apparatus 100 is installed, a dedicated commercial power source line that is not shared with other electronic devices is usually prepared. However, in an office or the like where a large number of power source extension cables, such as table taps, are used, other electronic devices can be inadvertently connected to the same commercial power source 201 as the image forming apparatus 100.

In an office or the like, for example, a table tap 201*a* can be used and a personal computer (PC) 210 as an other electronic device and the image forming apparatus 100 might be accidentally connected to the same commercial power source 201 as shown in FIG. 7. In such a case, the capacity of the power source to which the devices are connected is insufficient for the electric power consumed by the connected electronic devices. Accordingly, regardless of the condition of the image forming apparatus 100, the input voltage drop of the power source in the image forming apparatus 100 occurs along with the amount of power consumed by the other electronic device (PC 210) that shares the power source.

Figure 8:
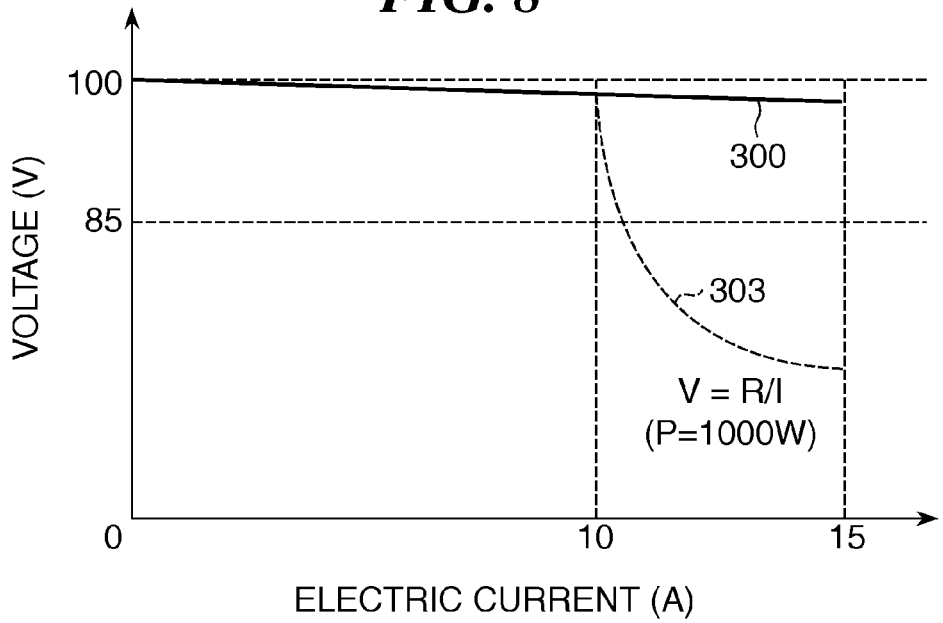
FIG. 8 is a graph showing the relation between an electric current that flows in the image forming apparatus of FIG. 7 and a source voltage in a 100V/15 A environment when a power source is shared.

FIG. 8 illustrates the relation between an electric current that flows in the image forming apparatus 100 of FIG. 7 and a source voltage in a 100V/15 A environment when a power source is shared.

Under an ideal condition with infinitely small source impedance, little drop of source voltage occurs even when power consumption increases to as high as 15 A (straight line 300). However, when power source capacity is insufficient, e.g., when power source capacity is only 1000 W, no problem occurs up to 10 A (i.e., there is little drop of source voltage). However, after 10 A is exceeded, source voltage steeply decreases because power source capacity is insufficient (line 303). The relation therebetween becomes an inverse relationship because the electric power is constant.

Figure 9:
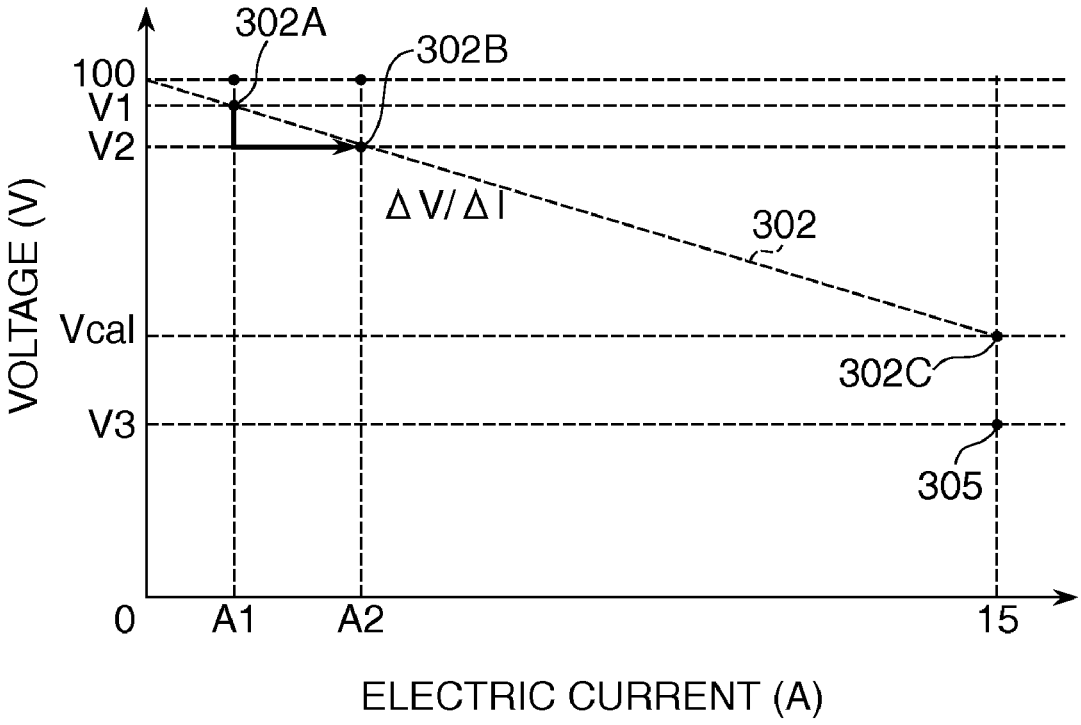
FIG. 9 is a graph showing the relation between the electric current in the image forming apparatus of FIG. 7 and the source voltage when a power source is shared used in a 100V/15 A environment.
Figures 10, 11:
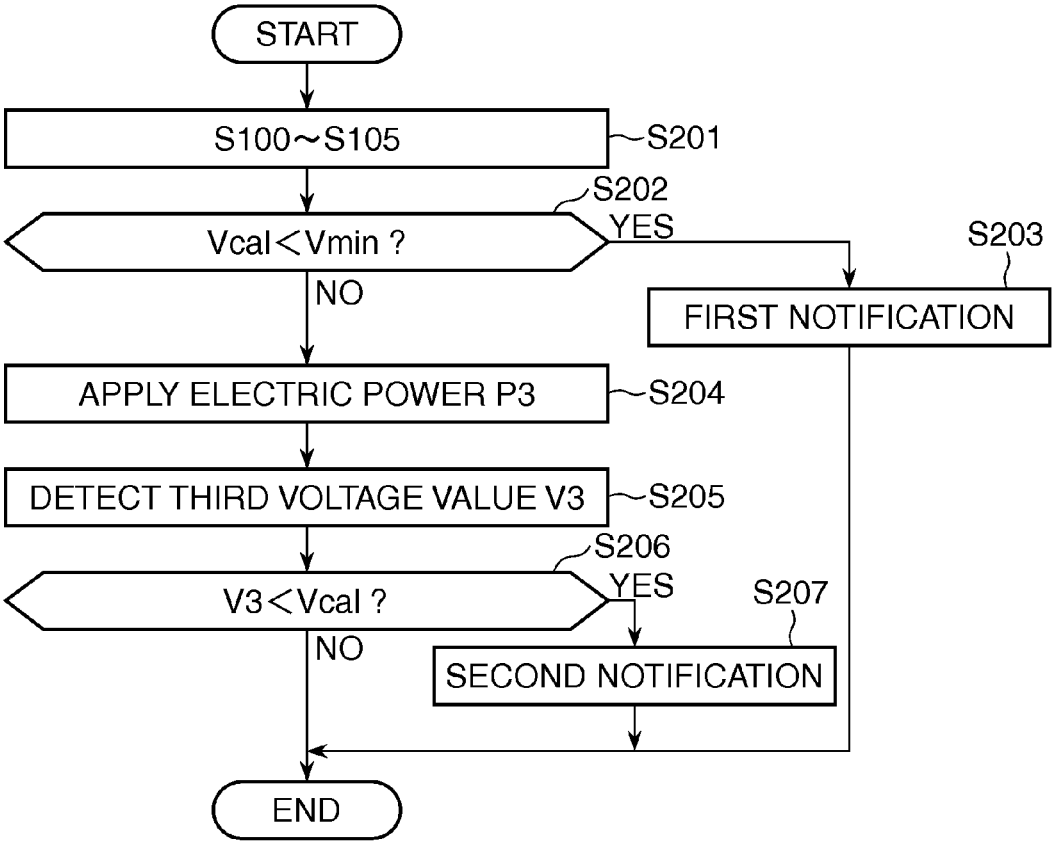
FIG. 10 is a flowchart of predicting and providing a notification about the abnormality of the power source voltage in the present embodiment.
FIG. 11 is a view showing an example of displayed contents displayed as a second notification.

Next, how to detect an abnormality caused by an electric power shortage is described. FIG. 9 illustrates the relation between the electric current in the image forming apparatus 100 of FIG. 7 and the source voltage used in a 100V/15 A environment when a power source is shared. FIG. 10 is a flowchart showing a process of predicting and providing a notification about the abnormality of the power source voltage in the present embodiment. The process of the flowchart of FIG. 10 is executed by the CPU 204.

At step S201 of FIG. 10, processing similar to that of steps S100 to S105 of FIG. 5 is executed. At steps S202 and S203, processing similar to that of steps S106 and S107 of FIG. 5 is executed, respectively. However, if Vcal≧Vmin at step S202, the flow proceeds to step S204. After processing at step S203, the present process is terminated.

At step S204, the CPU 204 gives to the fixing unit control circuit 205 a control signal for passing a 15 A electric current so that electric power of power value P3 required for a printing operation is applied to the fixing unit 208. As a result, an electric current of 15 A flows to the fixing unit 208. The CPU 204 stores a source voltage detected by the voltage sensor 203 with electric power of power value P3 being applied in the storage section 204*a* (see FIG. 2) as the third voltage value V3 (see FIG. 9) (step S205).

The CPU 204 then compares the stored third voltage value V3 with the predicted voltage value Vcal computed, and determines whether V3<Vcal or not (step S206). If V3≧Vcal as a result of the determination, the CPU 204 determines that there will be no problem in image forming operations and terminates the present process without performing second notification.

That is to say, if power source capacity is sufficient, a voltage drop at the time of an image forming operation is only a drop that is associated with source impedance, thus the third voltage value V3 is equal to the predicted voltage value Vcal. However, if power source capacity is insufficient, electric power supplied to the fixing unit 208 is limited, causing voltage to sharply drop as illustrated in FIG. 8. Therefore, a voltage drop due to an electric power shortage is superposed in addition to the voltage drop associated with source impedance, thus the third voltage value V3 is a value smaller than the predicted voltage value Vcal. In other words, by comparing the predicted voltage value Vcal with the third voltage value V3 detected at the time of an actual operation, it is possible to determine whether electric power is insufficient or not.

If V3<Vcal as result of the determination at step S206, the CPU 204 determines that electric power is insufficient and performs second notification for indicating that the electric power is insufficient via the console section 207 (step S207) and then terminates this process.

FIG. 11 illustrates an example of displayed contents as a second notification. As an example of the second notification, a message such as that shown in FIG. 11 is shown on the display section 207*a* of the console section 207. This message has contents indicating that there is a problem in the power source environment and prompts the user to check whether there is any device connected to the same power source line. The user can address this problem by disconnecting the other device sharing the power source from the table tap 201*a*.

The present embodiment provides advantages similar to those of the first embodiment. Besides, since it performs the second notification when V3<Vcal, the present embodiment can provide a notification that a voltage drop will occur during a printing operation due to an external factor such as sharing of a power source before an actual printing operation. For example, it can provide a notification about shortage of electric power caused by an electronic device other than the image forming apparatus 100 (other than the electronic device).

In particular, it makes it possible to determine by which cause a voltage drop is occurring, i.e., whether the voltage drop is occurring due to high source impedance or due to shortage of electric power. This enables quick identification of a cause even at the time of a problem of a voltage drop and can shorten downtime of the apparatus associated with a power source problem.

In the second embodiment, it is also possible to provide an additional step for determining whether V3<Vmin or not between steps S206 and S207 and not to perform the second notification when V3≧Vmin (i.e., to skip step S207). On the other hand, if V3<Vmin at the additional step, third notification for indicating the fact may be performed. In this case, the third notification may be performed instead of or in addition to the second notification.

Alternatively, the step of determining whether V3<Vmin may be provided in place of step S206 and notification for indicating the fact may be performed at step S207 only when V3<Vmin.

In the second embodiment, the process of FIG. 10 may be executed at the time of the initial printing after the apparatus is powered up.

In the process of FIG. 10, the first notification process (steps S201 to S203) and the second notification process (steps S204 to S207) may be allowed to be performed independently of each other. In such a case, the second notification process is made executable with the predicted voltage value Vcal already stored after the first notification process has been executed at least once. While there is not much point in conducting the first notification process a number of times in the same apparatus, the second notification process can be useful when other devices sharing the same power source have been changed and therefore should be performed at predetermined time intervals or each time an other device has been changed.

If the second notification process is performed separately, it may be performed during an actual printing operation. It does not have to take place in every printing operation but may be performed in the initial printing after the apparatus is powered up, for example. If the second notification (step S207) is carried out in a case where it is configured to be performed in an actual printing operation, similar measures to those taken in the above-mentioned-Japanese Laid-Open Patent Publication (Kokai) Nos. 06-35562 and 2007-102008 (e.g., initialization or reducing printing speed) are preferably taken.

The way of performing the first and second notification in the first and second embodiments is not limited to a visual method, such as display of a message, and may be provided by sound or by printing and outputting contents of notification on a sheet of paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2008-151869 filed Jun. 10, 2008, which is hereby incorporated by reference herein in its entirety.

What is claimed is:

1. An electronic device, comprising:

a load configured to operate on electric power supplied from a commercial power source;

a detection unit configured to detect a source voltage input from the commercial power source;

a storage unit configured to store an operation guarantee voltage value that is required for operation of said load;

a control unit configured to control electric power applied to said load; and a notification unit configured to perform notification, wherein said control unit computes a source voltage at the time of operation of said load as a predicted voltage value based on a first voltage value detected by said detection unit while electric power of a first value is applied to said load and a second voltage value detected by said detection unit while electric power of a second value which is greater than the first value is applied to said load, and if the predicted voltage value computed is smaller than the operation guarantee voltage value stored in said storage unit, performs predetermined notification via said notification unit.

2. The electronic device according to claim 1, wherein said control unit performs a second notification via said notification unit if a third voltage value detected by said detection unit during operation of said load is smaller than the predicted voltage value.

3. The electronic device according to claim 2, wherein said control unit provides notification on shortage of electric power caused by a device other than the electronic device as the second notification.

4. The electronic device according to claim 1, wherein said control unit provides notification relating to a problem of a commercial power source facility that supplies electric power to the electronic device as the predetermined notification.

5. The electronic device according to claim 1, wherein the electric power of the second value is smaller than an electric power value at the time of operation of said load.

6. The electronic device according to claim 1, wherein the electronic device is an image forming apparatus that forms a toner image on recording paper and includes a fixing unit for heating and fixing the toner image formed on the recording paper, and said load includes said fixing unit.

7. An image forming apparatus that operates on electric power supplied from a commercial power source, the image forming apparatus comprising:

an image forming section configured to form a toner image on a sheet;

a fixing unit configured to heat and fix the toner image formed on the sheet;

a fixing unit control section configured to control electric power supplied to said fixing unit;

a voltage detecting section configured to detect a voltage input from the commercial power source to the image forming apparatus;

a storage section configured to store an operation guarantee voltage value required for an image forming operation; and a control section configured to control said fixing unit control section so that electric power supplied to said fixing unit is adjusted, wherein based on a first voltage value detected by said voltage detecting section while electric power of a first value is supplied to said fixing unit and a second voltage value detected by said voltage detecting section while electric power of a second value which is greater than the electric power of the first value is supplied to said fixing unit, said control section computes a voltage that is applied from the commercial power source to the image forming apparatus when said fixing unit is operated with electric power of a third value-at the time of an image forming operation which is greater than the second value, and if the computed voltage is smaller than the operation guarantee voltage value, issues a warning.

* * * * *